United States Patent [19]

Beumel, Jr.

[11] 4,079,675

[45] Mar. 21, 1978

[54] CONTROLLED SOLUTION RELEASING DEVICE

[75] Inventor: Oscar F. Beumel, Jr., Newark, Ohio

[73] Assignee: The United States of America as represented by the Secretary of the Army, Washington, D.C.

[21] Appl. No.: 426,271

[22] Filed: Dec. 19, 1973

Related U.S. Application Data

[63] Continuation of Ser. No. 237,664, Mar. 24, 1972, abandoned.

[51] Int. Cl.[2] ..... F42B 23/00; F42D 5/04

[52] U.S. Cl. ..... 102/8; 55/388

[58] Field of Search ..... 55/35, 74, 159, 387, 55/388; 252/70, 194, 546, DIG. 11; 102/8

[56] References Cited

U.S. PATENT DOCUMENTS

| | | | |
|---|---|---|---|
| 2,578,324 | 12/1951 | Southwick, Jr. | 55/387 |
| 2,738,225 | 3/1956 | Meek | 55/387 |
| 3,309,849 | 3/1967 | Ward | 55/387 |
| 3,390,511 | 7/1968 | Norton | 55/35 |
| 3,523,408 | 8/1970 | Rosenberg | 55/159 |
| 3,718,513 | 2/1973 | Baer et al. | 149/109 |

FOREIGN PATENT DOCUMENTS

| | | | |
|---|---|---|---|
| 18,527 | 7/1925 | Netherlands | 55/288 |

*Primary Examiner*—Verlin R. Pendegrass
*Attorney, Agent, or Firm*—Nathan Edelberg; A. Victor Erkkila; Thomas R. Webb

[57] ABSTRACT

An article for use as a solution releasing control device in a fluid containing medium, such as air containing water vapor, is provided including an inner material composed of solid substance capable of sorbing this fluid and also capable of dissolving in this sorbed fluid, for example a hygroscopic, deliquescent agent such as lithium chloride or a mixture of lithium chloride and the tetrasodium salt of ethylenediaminetetraacetic acid. This inner material is enclosed in a container fabricated of a material which is substantially impermeable to the fluid in the medium surrounding it and is substantially nonwettable by the solution formed from the sorbed fluid and the sorbing agent, for example an essentially hydrophobic film, such as polyethylene. The container is provided with perforations of pre-determined number and size to provide an accurately controlled fluid sorbing and solution releasing device.

6 Claims, 3 Drawing Figures

CONTROLLED SOLUTION RELEASING DEVICE

GOVERNMENTAL INTEREST

The invention described herein may be manufactured, used and licensed by or for the Government for governmental purposes without the payment to me of any royalty.

This application is a continuation of my copending application Ser. No. 237,664, filed Mar. 24, 1972, and now abandoned.

BACKGROUND OF THE INVENTION

The use of hygroscopic, deliquescent materials as sorption means for removal of water vapor from air is well known to the art. These materials have been utilized as desiccants and dehumidifying agents. The use of these agents as a method for producing a liquid solution for various end purposes has been explored briefly. For example, this method has been used in the self-sterilization of chemically oriented explosive mines. In the past, hygroscopic deliquescent materials have been incorporated into the explosive component in these mines to provide a non-mechanical method of sterilization, as described in U.S. Pat. No. 3,718,513. The mine design, of course, must allow for contact of the materials with water vapor in order for the method to function.

While incorporation of these materials into the explosive in the mine is an effective method of sterilization, it is not completely satisfactory, since a long accurately-timed period before sterilization cannot be attained. This limitation occurs because as the hygroscopic, deliquescent material absorbs enough water vapor it immediately begins to drip, therefore sterilization begins as soon as the mines are exposed to moist air. Additionally, longer periods of time before sterilization are impossible to attain, because of the relatively rapid dispersal of the solution throughout the mine.

It is, therefore, an object of this invention to provide a means for accurately controlling the time necessary for sterilization of chemically oriented mines, such controlling means functioning by the use of a desired hygroscopic element, external but exposed to the mine, that for a number of days will not discharge any solution which might impair the effectiveness of the mine, then after the desired number of days will discharge the solution at a relatively high rate.

A further object is to provide a means for controlling the rate and amount of sorption, liquefaction and solution release by a sorbing material in a fluid containing medium such as air containing water vapor.

Another object is to provide a control means to prevent indiscriminate solution release by a hygroscopic, deliquescent material.

Other objects and many of the attendant advantages of this invention will be readily appreciated as the same become better understood by reference to the following description wherein it is shown that the above-mentioned objects are attained and the prior art deficiencies are overcome by the use of an essentially water vapor-impermeable film packet enveloping the sorbing and solution-releasing material, such packet having a preselected number of perforations of a predetermined size, to accomplish these objects. The term "solution", wherever used herein, means "liquid solution".

BRIEF DESCRIPTION OF THE DRAWINGS

Throughout the drawings the same numerals refer to the same items.

DESCRIPTION OF A PREFERRED EMBODIMENT

Figure 1:
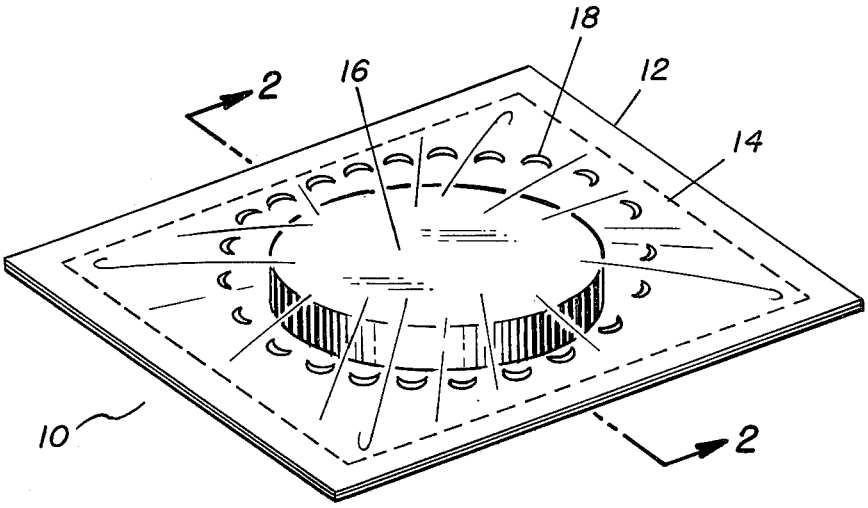
FIG. 1 is an isometric view of the perforated envelope containing the sorbing, solution-forming material.

My invention can best be shown in the context of the entire item 10. As shown in FIG. 1, the sorbing material is pressed into the form of a relatively-thin flat tablet 16. Two sheets or films of hydrophobic plastic film material are positioned on opposite sides of tablet 16 and sealed together at their edges 14 to form a thin closed bag or envelope 12, and then, a series of perforations 18 is formed in each side of the envelope, around the periphery of the tablet, as shown in the drawing. These perforations 18 are of a predetermined size and number to provide a preselected length of time before solution begins to drip from the item 10.

Figure 2:
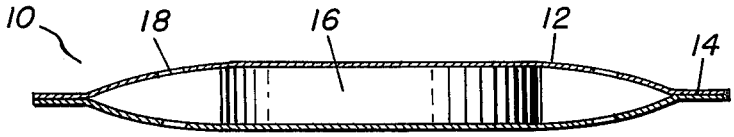
FIG. 2 is a cross-sectional view of the envelope and contained material, taken along line 2—2 of FIG. 1.
Figure 3:
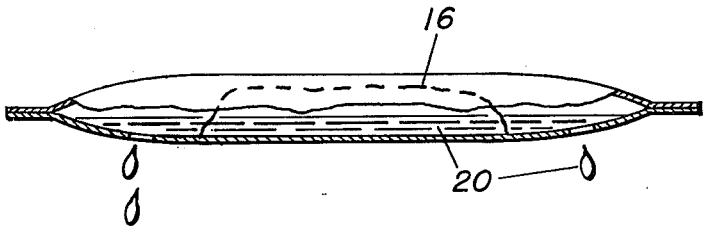
FIG. 3 is a cross-sectional view of the envelope and sorbing material after it has been exposed to air for a period of time.

In FIG. 2, the item 10 is shown in cross section to enable better visualization of the relationship between the tablet 16, envelope 12, the seal 14 and the perforations 18. FIG. 3 shows the item 10 in operation. As water vapor passes through the perforations 18, it is sorbed by the sorption tablet 16 which, over a period of time begins to dissolve and form a solution 20. Depending upon the size and number of holes 18, the length of time which the tablet 16 takes to form a solution 20 can be varied. Additionally, the size of the tablet 16 in relation to the free space inside the envelope 12 governs the amount of solution 20 which will be formed before it is released through the holes 18. Further, the size of the holes 18 and type of envelope 12 in relation to the surface tension of the solution 20 provides an additional factor in determining the rate of solution release.

The materials or additives which may be utilized to desensitize and ultimately sterilize the primary explosive ingredients of a mine include calcium chloride, lithium chloride, magnesium chloride, sodium sulfate, sodium hydroxide, potassium hydroxide, lithium bromide, cesium fluoride and cesium bromide.

The additive in the substantially anhydrous form is placed, either as loose powder or in pellet form, into a housing or bag which is water repellent, and the bag is then perforated to form the holes 18. Water vapor is extracted from the atmosphere through the holes 18 by the hygroscopic additive, which then deliquesces, thereby spreading a solution of the additive through the bag, Depending on the design, various times can be achieved before the solution is released through the holes 18 and begins to drip from item 10. Lithium chloride is especially useful for this purpose due to its ability to deliquesce at relatively low humidity. Furthermore, the additive in solution form will react with the primary explosive component, thereby sterilizing the mine that is exposed to the released solution. The bag or envelope will be dry on the outside for a predictable number of days and then the liquid will flood out until the internal solution is in equilibrium with the ambient humidity.

The type of mine preferred in my system is one which utilizes a pressure-sensitive mixture of a primary explosive such as lead azide and a secondary explosive such as RDX or HMX. These explosives are effective if composed of about 40% by weight lead azide and 60% by weight RDX. However, any type of mine which utilizes explosive components that can be desensitized by a solution containing the salt of a material which undergoes water vapor sorption and subsequent liquefaction in the sorbed water vapor, may also be used with my invention. For example, the hygroscopic additives of this invention are also effective for desensitizing organic azides; e.g., cyanuric triazide. Thus, antipersonnel mines containing an organic azide, as well as an inorganic azide, as the primary explosive can be desensitized by the aqueous hygroscopic additive to such a degree that the mine is no longer sensitive to personnel action. However, owing to their poor solubility in aqueous media, such organic azides will react slowly with the aqueous hygroscopic additive and ultimate complete sterilization of the mine will be extremely slow.

To insure sorption of enough water vapor to accomplish sterilization of the explosive ingredients, the tetrasodium salt of ethylenediaminetetraacetic acid is added in powder form to the lithium chloride additive. The function performed by the EDTA salt is believed to be that it makes the tablet form porous so that all of the lithium chloride converts to the monohydrate before any solution forms, thus insuring that premature release will not occur.

The items of this invention which may be used to sterilize military, chemically oriented mines are set forth in the following example.

EXAMPLE 1

A 3 gram pellet was pressed out of a loose anhydrous mixture consisting of 95% by weight lithium chloride and 5% by weight of the tetrasodium salt of ethylenediaminetetraacetic acid. This tablet was then sealed in an envelope made of Alathon 400 A 102 polyethylene film (a registered trademark of E. I. DuPont de Nemours Co. for their polyethylene film). Twelve holes were punched into the film with a 22 gauge hypodermic needle and the packet was tested for the amount of time necessary for solution release. A large number of these packets were made with the number of holes varying from 8 to 24 and the diameter of the holes varying from 20 gauge to 24 gauge.

Generally, humidity combined with the size and number of holes in the packaging film determine the active period of the device.

The type of film used for the bag 12 is important since the more elastic films tend to produce smaller holes and the tougher films tend to produce larger holes, using the same size needle. Additionally, the film to be used has to be essentially impervious to water vapor and non-wettable by the hygroscopic salt solutions. It also has to be resilient, though and sealable. One film that meets all these requirements is a high quality polyethylene, "Alathon 400 A 102", produced by DuPont. It is flexible even when cold. It is easily heat sealed. It is hydrophobic, and allows fairly uniform puncturing of holes without stretching, tearing, etc. Other envelope film materials that were found to be satisfactory were films such as polyvinyl fluoride and polyester and coated cellulosic or other substrates such as polyethylene coated paper and polyethylene coated cellophane.

The size of the preforations was found to be dependent on the diameter and shape of the point of the needle and on the film. All else being equal, a larger diameter needle produced a larger diameter hole. However, a needle with a symmetrical point, like a sewing needle made a larger hole than a hypodermic needle for the same diameter shaft. The sewing needle tended to punch a large hole which stretched the film around the hole into a skirt-like protrusion. The hypodermic needle tended to slice a hole with less stretching and produced an irregular crescent shaped hole, which tends to close, especially with the more elastic films like polyethylene. This means that with the same diameter needle a hypodermic needle produces a hole with smaller cross section and therefore produces a device with a longer active period. Of course, large holes allow moisture to be picked up faster. The same is true for a large number of holes. The more open hole gives faster rates, the ones that tend to close absorb water more slowly. The film of choice would, of course, depend on the timing desired.

The use of a laser to perforate the films was also investigated. The holes made with a laser beam were ideal since they were burned through uniformly and had a thicker periphery where the molten film had hardened. This avoided another problem wherein the thin stretched edges of the hole tended to shrink shut on long standing if the strains produced on puncture were allowed to relax. There are no strains produced with the laser beam. As a result, where good results were obtained with the punched holes, excellent results were obtained with a few tests run on packages containing laser pierced holes.

The parameters governing the general performance of my invention are as follows: the sorption and liquefaction properties of the enclosed material determine the amount of solution that can be formed. The chemical properties of the enclosed material will determine the efficacy of the device depending upon the desired end use of the solution produced, e.g., desensitization of a mine, dispensation of fertilizer, closing an electric circuit or activation of a battery. The holes in an impervious film initially insure that the availability of water vapor or other fluid for sorption by the enclosed material is governed by the number and size of holes used. Since the film is not wetted by the solution as formed, this hydrophobic property will result in the packet filling before solution is forced out through the holes. Additionally, the internal volume of the package governs the amount of solution that will form before release. The size, shape and number of holes govern the availability of fluid access to the enclosed material and further govern the rate of egress for the solution formed.

My invention provides an accurate and positive control exercise over solution release. This control can be achieved economically, silently and with relative ease. Hygroscopic, deliquescent or indeed any sorbing materials which undergo liquefaction and form a solution with the sorbed fluid may be used alone to produce their salt solutions, or they may be used in mixtures to provide a mixed salt solution. It is believed that a mixed salt solution will depend upon the solubility of one salt in the solution of the other.

The utility of my invention is quite broad and includes use of the device as a means for releasing electrolyte for activation of a battery, or as a means for releasing a fertilizer solution over a long period of time if it were planted with a seedling, or as a time switch to close or open an electric circuit if the solutions were designed to be properly conductive. Additionally, if the proper sorbing material was used the fluid sorbed could be any fluid.

Thus, it can be seen that the use of my invention. where an inner solid material, having the property of sorbing a fluid and then undergoing liquefaction in that sorbed fluid is enveloped in a container, the container being impervious to the sorbed fluid and being essentially non-wettable by a solution of the fluid and the sorbing material, the container also having a preselected number of perforations with a predesigned cross-sectional area, forms the basis for an advance in the art.

I wish it to be understood that I do not desire to be limited to the exact details described, for obvious modification will occur to a person skilled in the art.

I claim:

1. A device for controlled formation and controlled release of a useful solution comprising:

a. solid material capable of sorbing water vapor and reacting therewith to form a useful liquid solution; and b. a container enclosing said solid material, the material of said container being substantially impervious to said water vapor and substantially non-wettable by said solution, said container being completely closed except for a predetermined number of relatively small openings therethrough of predetermined size through which said water vapor enters said container at a predetermined rate and contacts said solid material to form said solution, and through which said solution is released from said container at a predetermined rate; at least 55% of said solution being selected from the group consisting of calcium chloride, lithium chloride, magnesium chloride, sodium sulfate, lithium bromide, cesium fluoride, cesium bromide, sodium hydroxide and potassium hydroxide; and said solution being capable of sterilizing the explosive component of an explosive mine.

2. A device as in claim 1, where said container is formed from an essentially hydrophobic film material selected from the group consisting of polyethylene, polyvinyl fluoride and polyester.

3. A device as in claim 1, wherein said container is formed from a cellulosic substrate coated with polyethylene.

4. The combination of the device of claim 1 with an explosive mine external to said container and exposed to said solution released therefrom.

5. The combination of claim 4, wherein the explosive component of said mine is a pressure-sensitive mixture of a primary explosive, such as lead azide, and a secondary explosive, such as RDX or HMX.

6. The combination of claim 4, wherein said solid material consists of a mixture of from about 55 to 95% by weight of lithium chloride and from about 5 to 45% of the tetrasodium salt of ethylenediaminetetraacetic acid.

* * * * *